United States Patent [19]

Dreschel et al.

[11] Patent Number: 5,004,220

[45] Date of Patent: Apr. 2, 1991

[54] METHOD AND APPARATUS FOR CHANGING THE DIRECTION OF SHEET CONVEYANCE

[75] Inventors: Jürgen Dreschel, Karben; Peter Hö, Oppershofen; Stephan Mös, Bad Nauheim, all of Fed. Rep. of Germany

[73] Assignee: Bell & Howell GmbH, Friedberg, Fed. Rep. of Germany

[21] Appl. No.: 404,001

[22] Filed: Sep. 7, 1989

Related U.S. Application Data

[63] Continuation of Ser. No. 309,907, Feb. 14, 1989, abandoned, which is a continuation of Ser. No. 201,256, May 25, 1988, abandoned, which is a continuation of Ser. No. 884,449, Jul. 11, 1986, abandoned.

[30] Foreign Application Priority Data

Jul. 13, 1985 [DE] Fed. Rep. of Germany ..... 352040

[51] Int. Cl.[5] ..... B65H 29/00

[52] U.S. Cl. ..... 271/184; 271/225; 271/248; 271/251; 271/253

[58] Field of Search ..... 271/225, 184, 226, 243, 271/248, 250, 251, 253, 258, 265, 273, 274, 176, 194, 195, 223, 200, 177; 198/786, 457

[56] References Cited

U.S. PATENT DOCUMENTS

| | | | |
|---|---|---|---|
| 1,987,339 | 1/1935 | Hitchcock | 271/225 |
| 2,249,186 | 7/1941 | Spiess | 271/225 |
| 2,964,161 | 12/1960 | Lopez | 271/225 X |
| 3,532,338 | 10/1970 | Brinson et al. | 271/273 X |
| 3,881,721 | 5/1975 | Hitch | 271/225 X |
| 4,014,539 | 3/1977 | Goodwin | 271/225 X |
| 4,061,329 | 12/1977 | Sachuk et al. | 271/225 X |

FOREIGN PATENT DOCUMENTS

| | | | |
|---|---|---|---|
| 2000720 | 9/1969 | France . | |
| 17853 | 2/1981 | Japan | 271/265 |
| 139944 | 8/1983 | Japan | 271/226 |
| 26840 | 2/1984 | Japan | 271/226 |

*Primary Examiner*—David H. Bollinger

*Attorney, Agent, or Firm*—Griffin, Branigan & Butler

[57] ABSTRACT

The direction of conveyance of paper sheet is changed through an angle of 90° between processing and/or handling stations. Troublefree operation is ensured and an adjustment in adaptation to different paper sizes is permitted by the provision of a guide ruler 18 which is provided with pressure-applying balls 8 which cooperate with inclined driven conveyor rollers 15. The guide ruler 18 is fixed to a receiving deck 16 and comprises a continuous guiding flange 21 which depends below the level of the apices of the rollers 15. The position of the discharge end of a feeding conveyor 14 is adjustable toward and away from the guide ruler 18 .

8 Claims, 2 Drawing Sheets

METHOD AND APPARATUS FOR CHANGING THE DIRECTION OF SHEET CONVEYANCE

This application is a continuation of Ser. No. 309,907, filed Feb. 14, 1989, now abandoned, which is a continuation of Ser. No. 201,256, filed May 25, 1988, now abandoned, which is a continuation of Ser. No. 884,449, filed July 11, 1986, now abandoned.

BACKGROUND

I. Field of the Invention

This invention relates to sheet feeding and delivering, and particularly to apparatus and method for deflecting or changing the direction of conveyance of paper sheets traveling between processing and/or handling stations.

II. Prior Art and Other Considerations

Apparatus of the type to which this invention pertains are used to deliver a paper sheet from a first station or input station to a second station or processing station, with the direction of travel of the sheet entering the second station being in a direction which is at right angles to the direction of travel of the paper sheet leaving the input station. Examples of suitable types of respective first and second stations are (1) a cutter station whereat individual paper sheets are severed from an endless form, and (2) a downstream folding station to which the severed sheets are delivered in a direction which is at right angles to the direction of travel of the paper sheet leaving the cutter station. Other examples of suitable types of respective first and second stations are (1) a first folding station and (2) a downstream second folding station (assuming that a paper sheet is to be folded along crossing fold lines). In accordance with the above, in addition to its normal meaning the terminology "paper sheet" is also used herein to describe an article which has been obtained by a folding of a paper sheet. Also, in addition to its normal meaning the terminology "edge of paper sheet" is also used herein to describe a fold line.

Prior art apparatus of the type to which this invention relates generally comprise a feeding conveyor which has a discharge end at a receiving deck. The receiving deck is provided with an array of driven conveyor rollers (having apices disposed approximately in the plane of the deck) and a guide ruler for laterally guiding the paper sheet, particularly the edge of the sheet which is the leading edge (in the direction of conveyance of the feeding conveyor). Typically the axes of the conveying rollers are not at right angles to the direction to which the paper sheets are deflected but are so inclined that the rollers tend to move the paper in a direction that has a component which is directed toward the guide ruler. The guide ruler is provided with movably mounted balls which are associated with respective conveying rollers and bear on the apices of the associated rollers.

In apparatus of the type described herein, once a paper sheet is fed in a first direction from the input station, the guide ruler is used to laterally guide the paper sheet as the apparatus conveys the sheet in a second direction of travel to the processing station. It has been found that the paper sheet to be handled can be more precisely deflected to travel in the second or predetermined direction and, as a result, the paper sheet can be more precisely processed or handled in the processing or handling station which is downstream with respect to the second direction, if the distance from the discharge end of the feeding conveyor to the guide ruler is adjusted in dependence on the size of the paper. If the papers to be handled differ greatly in size, that distance must be properly adjusted to ensure a trouble-free and reliable conveyance of the paper sheets.

According to prior art practice, an adjustment of the distance between the guide ruler and the discharge end of the feeding conveyor was facilitated by a guide ruler which was displaceable along the rotational axes of the conveying rollers. To make displacement of the guide ruler feasible, a guiding flange of the guide ruler had to be formed with arcuate recesses so that the conveying rollers would be accommodated and so that portions of the guiding flange would depend below the level of the apices of the conveying rollers. The sheet edge to be guided was thus prevented from moving between the lower edge of the guiding flange of the guide ruler and the apices of the conveying rollers.

Despite prior art efforts to prevent paper jams of the type described, experience has shown that if a paper sheet is delivered by the feeding conveyor at a relatively high speed and if the sheet edge to be guided initially extended at a small angle to the guiding flange of the guide ruler, the leading edge or corner of the sheet can be caught at the accurate recesses of the guiding flange of the guide ruler In such a case a paper jam occurs and operation of the apparatus is halted.

In view of the foregoing, it is an object of the present invention to provide an apparatus which changes the direction of conveyance of a paper sheet in a manner whereby disturbances due to a catching of a paper sheet at the guide ruler will be reliably avoided, with the distance between the guide ruler and the discharge end of the feeding conveyor being adjustable.

SUMMARY

A guide ruler is substantially fixed to a receiving deck. A feeding conveyor is adjustable parallel to the direction in which it conveys sheets so that the position of the discharge end of the feeding conveyor relative to the guide ruler can be adjusted in accordance with the size of the paper sheets to be handled. The guide ruler is profiled and has a continuous flange. At the end faces of the conveying rollers which face the guide ruler the flange depends below the level of the apices of the rollers.

The guide ruler is fixedly disposed near the end faces of the conveying rollers which face the guide ruler. As a result, the guiding flange of the guide ruler need not be formed with arcuate recesses, but is continuous and has in cross-section an angular or hooked shape so as to define a guiding groove. The guiding groove is disposed in close proximity to the end faces of the conveying rollers and serves to receive the paper-to-be-guided at its edge. An adjustment of the distance between the guide ruler and the discharge end of the feeding conveyor is facilitated by the fact that the feeding conveyor, preferably comprising at least two juxtaposed drive belts, is adjustable. In this regard, a pressure-applying belt array, which is trained around pairs of pulleys, is biased against the upper courses of the drive belts. At the discharge end of the feeding conveyor the drive belts are trained around pulleys which are rotatably mounted on a carriage. The carriage is displaceable toward and away from the guide ruler for an adjustment of the discharge end in accordance with the size of the paper. Rollers are provided to support a loop of the drive belts and are displaceable so as to maintain a path of constant length for the drive belts.

In one embodiment the receiving deck comprises at its receiving end a receiving area. The receiving area is disposed directly opposite or downstream from the discharge end of the feeding conveyor and is formed with a number of apertures through which air can be sucked by a suction fan disposed under the apertures. On that side of the receiving area which faces the conveying roller array the receiving deck is provided with a further conveying roller which is parallel to the axes of the above-mentioned rollers, but which cooperates with a pressure-applying roller. The pressure-applying roller is operable in a controlled manner, as by an actuator comprising, e.g., a solenoid.

The invention also provides a method of deflecting or changing the direction of paper sheets on a path of travel between processing and/or handling stations. According to the method, a paper sheet is conveyed by a feeding conveyor onto a receiving deck and into engagement with a guide ruler. The guide ruler preferably extends at right angles to the direction of conveyance of the sheet from the feeding conveyor and has pressure-applying balls movably mounted therein. The balls bear on the apices of conveying rollers. The axes of the rollers are so inclined that the direction of conveyance of the conveying rollers has a component directed toward the guide ruler.

Paper sheets which have been delivered to the receiving deck are initially retained on a receiving area of said deck for a short time, particularly in an area wherein air is sucked from the underside of the paper sheets. The paper sheets are subsequently transferred by auxiliary drive means to the above-mentioned conveyor roller array. The auxiliary drive means can comprise an additional conveyor roller which is disposed in the receiving area and which is also inclined. A pressure-applying roller operated by an actuator (such as a rotary solenoid in response to an actuating signal) is urged against the apex of the additional conveying roller. Actuation occurs at a predetermined delay after a signal indicating the delivery of a paper sheet to the receiving area of the receiving deck.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
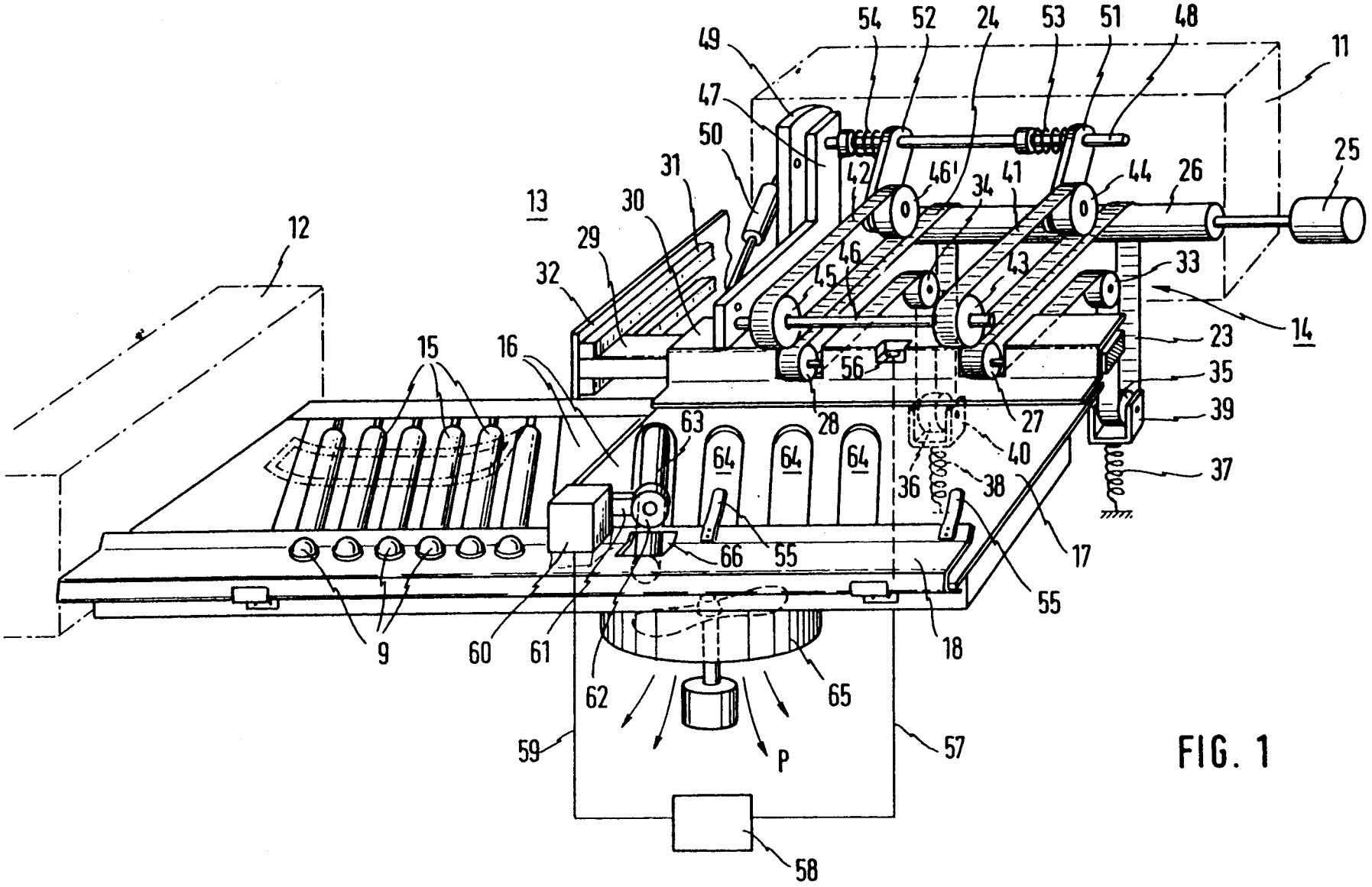
FIG. 1 is a diagrammatic perspective view showing apparatus for deflecting or changing the direction of travel of paper sheets according to an embodiment of the invention.

To facilitate the understanding of the invention, a prior art guide ruler 2 (shown in FIG. 3) will first be described. The guide ruler 2 is provided with a slide track which is of the type diagrammatically indicated in phantom lines by reference numeral 3 in FIG. 3. Slide track 3 extends parallel to the axes of rotation of the driven conveying rollers provided on a receiving deck. The slide track 3 serves to permit adjustment of the distance from the discharge end of a feeding conveyor to the guiding flange 1 of the guide ruler 2 to accommodate the size of the paper to be handled. The feeding conveyor is not illustrated but is understood to be positioned to the right in FIG. 3.

Figure 3:
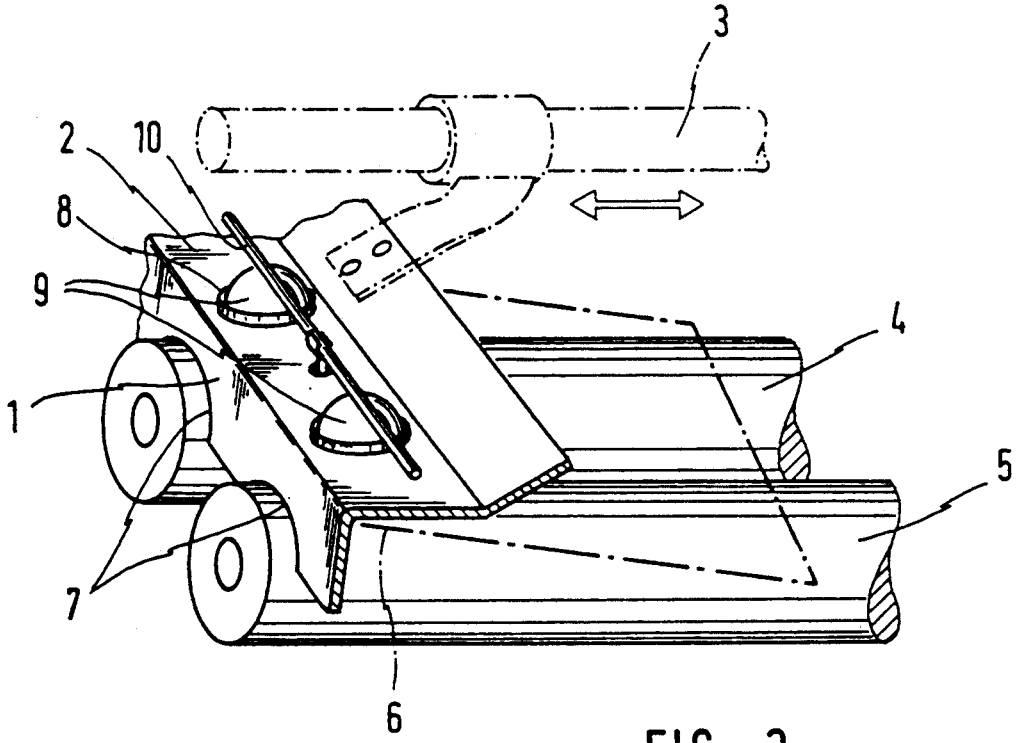

Of the conveying rollers, only those designated by reference numerals 4 and 5 are shown in FIG. 3. As seen from above, the axes of the conveyor rollers do not extend at right angles to the guiding flange 1 of the guide ruler 2 but are so inclined that, adjacent to the apices of the rollers, the direction of conveyance has a component directed toward the guiding flange 1 of the guide ruler 2. This arrangement ensures the precise alignment of a paper sheet that has an edge in contact with the guiding flange 1.

In order to prevent an edge 6 of a guided sheet from moving between the lower edge of the guiding flange 1 of the guide ruler 2 and the apices of the conveying rollers, the lower edge of the guiding flange 1 must be disposed below the level of the apices of the rollers. Because the guide ruler 2 can be displaced in sliding contact with the slide track 3 over the conveying rollers, the lower edge of guiding flange 1 must be formed with arcuate recesses 7 which extend around the periphery of the rollers with a predetermined clearance therefrom adjacent the apices of the rollers.

It is also apparent from FIG. 3 that the profiled guide ruler 2 comprises a web which is provided with plastic bushings 8. Pressure-applying balls 9, made of glass, plastic, or metal, for example, are rotatably mounted in bushing 8. A paper sheet that has been introduced between the pressure-applying balls 9 and the apices of the rollers will be urged against the conveying rollers by the balls 9. The pressure-applying balls 9 are retained in the bushings by an overhead rod 10. Rod 10 is secured by retaining fingers to the guide ruler 2 and extends over the pressure-applying balls 9.

If the guided edge 6 of the paper sheet that is to be deflected and transported is temporarily oriented at a small angle with respect to the guiding flange 1, the leading corner of the paper (which is toward the left as in FIG. 3) may be caught in one of the open gaps between the apices of the rollers and the upper portions of the arcuate recesses of the guiding flange 1. Such a paper jam between the roller and the guiding flange 1 creates considerable disturbance. The embodiments of the present invention shown in FIGS. 1 and 2 avoids paper jams of this type.

An input station 11 is diagrammatically shown in FIG. 1. It should be understood that in differing embodiments the input station 11 can take such forms as, for examples, a sheet feeder or a cutting device for severing form sheets from an endless form. The present discussion assumes that the input station 11 is a sheet feeder. A downstream processing or handling station 12 is so arranged relative to the input station 11 that at least one right angle is included between a first direction in which a paper sheet leaves the input station 11 and a second direction of travel in which the paper sheet is delivered to the processing or handling station 12.

A deflecting or direction-of-conveyance changing apparatus 13 of the kind discussed herein is disposed between the input station 11 and the processing or handling station 12. The apparatus 13 is so designed that a paper sheet that has been delivered by the input station 11 is delivered to the processing or handling station 12 in a second direction which is at a right angle to the first direction or feeding direction from which it leaves the input station. The apparatus described herein does not rotate the paper sheet during the direction change.

The deflecting apparatus 13 comprises a feeding conveyor 14 and a receiving deck 16 having a receiving area 17 in an upstream portion thereof. A downstream portion of the receiving deck 16 is provided with an array of driven conveying rollers 15.

Figure 2:
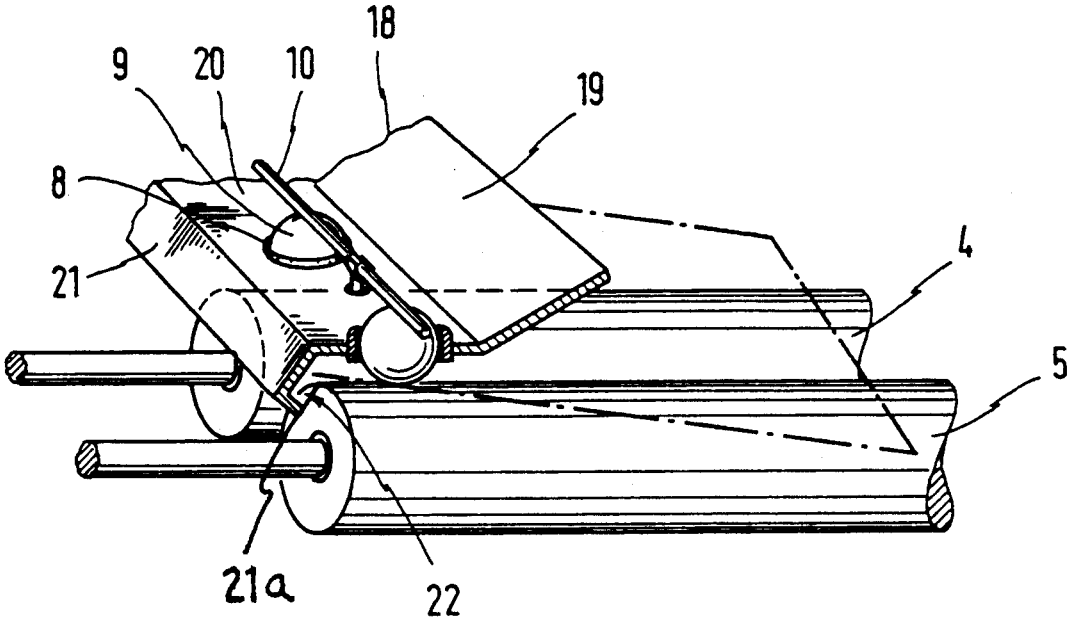
FIG. 2 is a perspective view showing a portion of a guide ruler and conveying rollers cooperating with said ruler according to an embodiment of the invention; and, FIG. 3 is a perspective view which shows portions of two conveying rollers and of a prior art guide ruler.

A guide ruler 18 having the cross-sectional shape which is shown in detail in FIG. 2 extends along the receiving deck 16 and has its major dimension extending parallel to the direction in which the paper sheets are delivered to the processing or handling station 12. The guide ruler 18 is stationary relative to the receiving deck 16. As used herein, the term "stationary" as applied to the guide ruler also includes a guide ruler which is hinged so that it can be swung upwardly out of the plane of the receiving deck. The guide ruler 18 cannot be displaced in a direction which is transverse to the direction in which the sheets are delivered to the station 12. In other words, the guide ruler 18 cannot be displaced in a direction which is parallel to the direction of conveyance of the feeding conveyor 14. Details of the conventional means used for connecting the guide ruler 18 to the receiving deck 16 have been omitted for the sake of simplicity.

The apices of the conveying rollers 15 are disposed approximately in the plane of the receiving deck 16. As seen from above, the axes of the rollers 15 do not extend at right angles to the direction in which the sheets are delivered to the station 12. Instead, in a horizontal plane the axes of the rollers 15 extend at an angle to a normal to the guide ruler 18 such that the direction of conveyance at the periphery of the roller adjacent to the apex of the roller includes a small component toward the guide ruler, as has already been explained with reference to FIG. 3.

As is apparent from FIG. 2, the guide ruler 18 has an entrance flange 19. Entrance flange 19 is inclined at an angle with respect to the horizontal and, as it extends from right to left as seen in FIG. 2, is inclined to converge toward the apices of the rollers. At its lowermost extent with respect to the horizontal the entrance flange 19 is succeeded by a web 20. Web 20 is essentially parallel to the apices of the rollers. The pressure-applying balls 9 are mounted in web 20 by means of plastic bushings 8 and by means of a rod 10 extending over the balls in a manner similar to that described hereinbefore with reference to FIG. 3. The guide ruler 18 differs from the guide ruler 2 of FIG. 3 in that the guide ruler 18 comprises a hook-shaped or angled guiding flange 21.

Guiding flange 21 extends away from web 20 in a manner such that guiding flange 21 is inclined at an angle with respect to the plane of web 20 and such that a lower edge of the guiding flange 21 is disposed below the level of the apices of the ends of rulers 4, 5 which face the guide ruler 18. At the level of the apices of the ends of the rollers 4, 5 the guiding flange 21 is angled back toward the rollers 4, 5 with the result that, near its distal end, the guiding flange 21 has a downwardly inclined ledge 21*a*. The inside surface of the hooked or angle guiding flange 21 forms a groove or channel 22. Groove 22, disposed on the level of the apices of the rollers, serves to guide the paper sheet at its edge. The guiding groove 22 is essentially continuous along the guide ruler 18 in the direction of sheet travel. That is, groove 22 is not interrupted by any recesses or projections in the direction for sheet travel. Because the guide ruler 18 is fixedly mounted on the receiving deck 16, the position of the guiding groove 22 relative to the end faces of the conveying rollers (e.g., rollers 4 and 5) will remain the same during operation regardless of the adjustment of the apparatus.

The width of the receiving area 17 of the receiving deck 16 (i.e., the width of the area of the upstream portion of deck 16 which is adjacent to the feeding conveyor 14) must be adjustable for adaptation to the size of the paper sheet to be handled. In the apparatus described herein, rather than adjusting the position of the guide ruler 18, the adjustment for paper size adaptation is effected by an adjustment of the position of the discharge end of the feeding conveyor 14 toward or away from the guide ruler in a direction which is parallel to the direction of conveyance of the feeding conveyor 14.

The feeding conveyor 14 comprises two parallel conveying drive belts 23 and 24, the upper courses of which serve to support and convey a paper sheet that is to be delivered to the receiving deck 16. At that end of the conveyor 14 which is adjacent to the input station 11 the conveying drive belts 23 and 24 are trained around a pulley 26. Pulley 26 is driven by a motor 25. At that end of the conveyor 14 which is adjacent to the receiving deck 16 the belts 23 and 24 are trained around pulleys 27 and 28, respectively, which are mounted on a carriage 29. The carriage 29 has a substantially stepped housing 30 which is formed with recesses or openings for accommodating the pulleys 27 and 28 and their axles.

Horizontal guide bars 31 are fixed to side walls 32 of the apparatus and serve to guide the carriage 29. A person skilled in the art will readily recognize that a corresponding slide track for the carriage 29 is provided on that housing wall which is opposite to the wall 32 shown in FIG. 2. For the sake of simplicity that second slide track has been omitted in FIG. 1 as is a nut that is provided on the carriage 29 and a screw which is fixed to the housing and serves to impart to the carriage 29 a horizontal movement in a direction which is parallel to the direction of conveyance of the feeding conveyor 14.

The lower courses of the conveying drive belts 23 and 24 extend from the pulleys 27 and 28 to the pulley 26 via deflecting rollers 33 and 34, respectively. The belts 23 and 24 extend around respective deflecting rollers 33 and 34 and from thence extend in a downward direction as shown in FIG. 1 to respective tensioning rollers 35 and 36. Belts 23 and 24 extend around respective tensioning rollers 35, 36 and from thence extended essentially upwardly to extend around the driven pulley 26.

As used herein, when the carriage 29 is in a given position, the upper courses of the belts 23 and 24 are said to be those portions of the belts which extend from pulley 26 to the respective pulleys 27 and 28. The lower courses of the belts 23 and 24 include length-compensating portions which extend from respective pulleys 33 and 34 via respective tensioning pulleys 35 and 36 to the driven pulley 26.

The tensioning rollers 35 and 36 are mounted in U-shaped bearing brackets 39 and 40, respectively.

It is apparent that a displacement of the carriage 29 toward and away from the guide ruler 18 will result in an increase or decrease of the length of the upper course of each conveying drive belt 23 or 24, whereas the associated length-compensating loop is decreased or increased in length in conjunction with an increase or decrease of the length of the spring 37 or 38.

Pressure-applying belts 41 and 42 are disposed over the conveying drive belts 23 and 24, respectively, and are trained around pairs of freely rotatable pulleys 43, 44 and 45, 46. Those pulleys 43 and 45 which are adjacent to the receiving deck 16 are rotatably mounted on an axle 46. Axle 46 constitutes a part of a frame 47. Frame 47 has angled side members which are pivoted by a pivot 48 to supports which are secured to the housing. By means of pneumatic springs 50 the side members of the frame 47 are biased toward the conveying drive belts 23 and 24.

The pulleys 44 and 46 are rotatably mounted on respective links 51 and 52. Links 51 and 52 are also pivoted to the pivot 48. The pivot 48 is surrounded by coil springs 53 and 54. Springs 53 and 54 bear on collars secured to the pivot 48 and urge the links 51 and 52 toward the conveying drive belts 23 and 24. As a result, the pulleys 44 and 46 tension the associated pressure-applying belts 41, 42 and, in cooperation with the pneumatic springs 50, urge each pressure-applying belt against the associated conveying drive belt.

A paper sheet which has been delivered by the input station 11 will be received between the conveying drive belts 23 and 24 on the one hand, and the pressure-applying belts 41 and 42 on the other hand. The operation of driven pulley 26 causes the thusly-received sheet to be conveyed to the upstream receiving area 17 of the receiving deck 16.

At the receiving area 17 the leading edge of the sheet is then received under guide fingers 55 (which are secured to the guide ruler 18) and under the entrance flange 19 of the guide ruler. The leading edge then engages the guiding flange 21 of the guide ruler. The trailing edge of the sheet moves past a photodetector 56, of a type which is well known in the art and is not described in detail.

In response to the detected passage of the trailing edge of the sheet, the photodetector 56 delivers a signal via the line 57 to a controller 58. After a predetermined time delay from the receipt of the detector signal on line 57, the controller 58 delivers a control signal on line 59. The delay effected by the controller 58 is adjustable. The control signal is delivered via line 59 to an actuator 60. In the illustrated embodiment the actuator 60 comprises a rotary solenoid which serves to urge a pressure-applying roller 62 (rotatably mounted on a link 61) against a driven conveyor roller 63 which is provided adjacent to the receiving area 17 of the receiving deck 16. The axis of the conveyor roller 63 is parallel to the axes of the conveying rollers 15, i.e., the conveying roller 63 is inclined in the same manner as are the conveying rollers mentioned above.

The receiving deck 16 is formed in its upstream receiving area 17 with apertures 64 and a suction fan 65 disposed under the apertures 64. Air which is disposed under a paper sheet being conveyed is sucked by the fan 65 through the apertures or slots 64 in a downward direction as indicated by the arrows P.

When a paper sheet to be deflected has been conveyed by the feeding conveyor 14 onto the receiving area 17 of the receiving deck 16, the leading edge of such sheet is moved under the guide ruler 18 in the manner described above. An adjustable damping time elapses after the photodetector 56 generates the detector signal indicating the passage of the trailing edge of the sheet. After the time elapse the actuator 60 is energized so that the pressure-applying roller 62 is urged downwardly toward the driven roller 63 to engage the paper sheet therebetween. In this respect, the provision of an aperture 66 in the guide ruler enables the roller 62 to contact the upper surface of the engaged sheet. As a result, the paper sheet is moved toward the conveying roller 15 and toward the pressure-applying balls 9 (which cooperate with the conveying rollers 15) and is finally delivered to the station 12.

To facilitate the understanding of FIG. 1 it is mentioned that the illustration has been simplified and more clearly arranged in that those parts of the frame 47 and of the bearing brackets 49 which are disposed on the right in FIG. 1, and the pneumatic spring disposed between those parts, have been omitted.

While the invention has been particularly shown and described with reference to the preferred embodiments thereof, it will be understood by those skilled in the art that various alterations in form and detail may be made therein without departing from the spirit and scope of the invention. For example, in certain cases a paper sheet which has been delivered to the receiving deck 16 by the feeding conveyor need not be conveyed by the conveying roller 63 and the pressure-applying roller 62 after a delay. In such case the paper sheet will be immediately accelerated toward the station 12 by the driven conveying rollers.

The embodiments of the invention in which an exclusive property or privilege is claimed are defined as follows:

1. An apparatus for changing the direction of conveyance of paper sheets traveling between a first processing station and a second processing station, said apparatus comprising:

a feeding conveyor having a discharge end from which paper sheets are fed in a first direction, said discharge end being movable;

a receiving deck upon which the direction of conveyance of paper sheet is changed from said first direction to a second direction, said receiving deck provided with:

(1) a plurality of driven conveyor rollers having apices disposed approximately in the plane of the deck; and (2) a guide ruler substantially fixed to said receiving deck for laterally guiding a paper sheet at an edge thereof which is a leading edge with respect to said first direction wherein the axes of the conveying rollers are not at right angles to said second direction, but wherein the axes of the conveying rollers are so inclined that the rollers tend to move the paper in a direction that has a component which is directed toward the guide ruler, and wherein the guide ruler has a flange which (i) depends below the level of the apices of the rollers proximate those end faces of the conveying rollers which face the guide ruler and (ii) extends continuously along the beneath said plurality of driven conveyor rollers; and (iii) continuously and uninterruptedly prevents said paper sheet from descending beneath said flange; and means for adjusting the position of the discharge end of said feeder conveyor in a direction parallel to said first direction of conveyance so that the position of said discharge end relative to the guide ruler can be adjusted in accordance with the size of the paper sheets to be conveyed.

2. The apparatus of claim 1, wherein said guide ruler comprises:

a web portion which is essentially parallel to the apices of said rollers;

an entrance flange portion which extends upwardly in inclined manner from a first side of said web, said first side of said web being oriented toward said feeding conveyor; and, a guiding flange portion which extends downwardly in inclined manner from a second side of said web, said second side of said web being oriented away from said feeding conveyor and proximate end faces of said conveying rollers, said guiding flange portion being essentially hook-shaped in cross-section so as to form a guiding groove.

3. The apparatus of claim 1, wherein said receiving deck comprises an upstream receiving area which is disposed proximate the discharge end of said feeding conveyor, said upstream receiving area being formed with a plurality of apertures therein through which air can be sucked by a suction means disposed under said apertures, and wherein on a side of the receiving area which neighbors said plurality of conveying rollers the receiving deck is provided with a further conveying roller, said further conveying roller having an axis parallel to the axes of said plurality of rollers and being disposed to cooperate with a pressure-applying roller, said pressure-applying roller being operable in a controlled manner.

4. The apparatus of claim 3, further comprising:

detector means disposed proximate the discharge end of said feeding conveyor for detecting the discharge of a paper sheet from said feeding conveyor;

actuator means for urging said pressure-applying roller toward said further conveying roller when a control signal is applied to said actuator means; and, control means responsively connected to said detector means for generating said control signal.

5. The apparatus of claim 4, wherein said actuator means is an electromagnetic actuator.

6. The apparatus of claim 1, wherein said feeding conveyor comprises:

a stationary frame;

carriage means, said carriage means being connected to said stationary frame in a manner to be displaceable toward and away from said guide ruler for adjusting the position of the discharge end of said feeding conveyor;

at least two juxtaposed belt drives, said belt drives being trained at the discharge end of said feeding conveyor around pulleys rotatably mounted on said carriage means, said belt drives each comprising a continuous web which is tensioned by tensioned rollers, said tensioning rollers being displaceable in a manner to maintain tension on said belt drives when said carriage means is displaced; and, pressure-applying means biased against the sheet-contacting course of said belt drives for engaging and facilitating conveyance of paper sheets between said pressure-applying means and said belt drives.

7. The apparatus of claim 6, wherein pairs of pulleys support said pressure-applying means, and wherein said pulleys are mounted on a pivoted frame, said pivoted frame being pivotally mounted to said stationary frame and biased by resilient biasing means toward an upper course of the drive belts, wherein said pairs of pulleys comprise pulleys disposed adjacent an input end of the feeding conveyor and rotatably mounted in links, said links being pivoted on an axle of said pivoted frame and pivotally biased to tension the pressure-applying belts.

8. A method for changing the direction of conveyance of paper sheets traveling between a first station and a second station, said method comprising the steps of:

using a feeding conveyor to receive paper sheets from said first station and to feed said paper sheets in a first direction onto a receiving deck from a discharge end of said feeding conveyor:

actuating drive means associated with said receiving deck to impart motion to said paper sheets toward said second station;

using a plurality of driven conveyor rollers associated with said receiving deck to convey said paper sheets toward said second station and toward a guide ruler, said guide ruler being mounted on said receiving deck in a substantially stationary manner, said driven conveyor rollers having axes which do not extend at a right angle to said second direction of conveyance of the paper sheets on the receiving deck, wherein the axes of said conveying rollers are so inclined that said rollers tend to move the sheet in a direction that has a component toward said guide ruler, said guide ruler being essentially parallel to said second direction of conveyance and extending continuously along and beneath the apices of said driven conveyor rollers and serving to guide an edge of paper sheets being conveyed to said second station and continuously and uninterruptedly prevent said paper sheets from descending beneath said guide ruler; and, adjusting the position of the discharge end of said feeding conveyor in order to change the distance between said discharge end of said feeding conveyor and said guide ruler in a manner to selectively accommodate paper sheets of differing sizes on said receiving deck.

* * * * *

UNITED STATES PATENT AND TRADEMARK OFFICE

CERTIFICATE OF CORRECTION

PATENT NO. : 5,004,220

DATED : April 2, 1991

INVENTOR(S) : Jurgen Dreschel, et al.

It is certified that error appears in the above-identified patent and that said Letters Patent is hereby corrected as shown below:

On the title page item [75] should read as follows:

[75] Inventors: Jurgen Dreschel, Karben; Peter Hög, Oppershofen; Stephan Möbs, Bad Nauheim, all of Fed. Rep. of Germany

Signed and Sealed this

Eighth Day of September, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 5,004,220

DATED : April 2, 1991

INVENTOR(S) : Dreschel, et al

It is certified that error appears in the above-identified patent and that said Letters Patent is hereby corrected as shown below:

On the title page;

[75] Inventors: Jurgen Dreschel, Karben Fed. Rep. Germany; Stephan Mobs, Bad Nauheim Fed. Rep. Germany; Peter Hog, Oppershofen Fed. Rep. Germany; Heinz Dechert, Friedberg Fed. Rep. Germany

Signed and Sealed this

First Day of December, 1992

*Attest:*

DOUGLAS B. COMER

*Attesting Officer*

*Acting Commissioner of Patents and Trademarks*